US006058871A

United States Patent [19]

Tanner

[11] Patent Number: 6,058,871

[45] Date of Patent: May 9, 2000

[54] ANCHORING DEVICE FOR BOATS

[76] Inventor: Trenton Tanner, 6769 Loma Vista Ave., Hesperia, Calif. 92345

[21] Appl. No.: 09/220,030

[22] Filed: Dec. 23, 1998

[51] Int. Cl.[7] ..... B63B 21/00

[52] U.S. Cl. ..... 114/230.2; 114/294

[58] Field of Search ..... 114/230.1, 230, 114/230.2, 294; 135/118; 52/155

[56] References Cited

U.S. PATENT DOCUMENTS

| | | | |
|---|---|---|---|
| 3,023,723 | 3/1962 | Tays | 114/294 |
| 4,702,047 | 10/1987 | Stokes | 114/294 |
| 4,936,194 | 6/1990 | Horowitz | 114/230.2 |
| 5,564,232 | 10/1996 | Callaway | 135/118 |

*Primary Examiner*—Stephen Avila

[57] ABSTRACT

An anchoring device for boats including a T-shaped member comprised of a horizontal component and a vertical component. An upper end of the vertical component is secured to a midpoint of the horizontal component whereby the vertical component extends downwardly from the horizontal component in an essentially orthogonal relationship. The vertical component has a length greater than a length of the horizontal component. The horizontal component and the vertical component are constructed of PVC plastic tubing. The vertical component has a pointed lower end for penetrating a recipient surface. The T-shaped member receives a line from a boat wrapped therearound to facilitate securement of the boat to a shoreline.

1 Claim, 1 Drawing Sheet

FIG 1
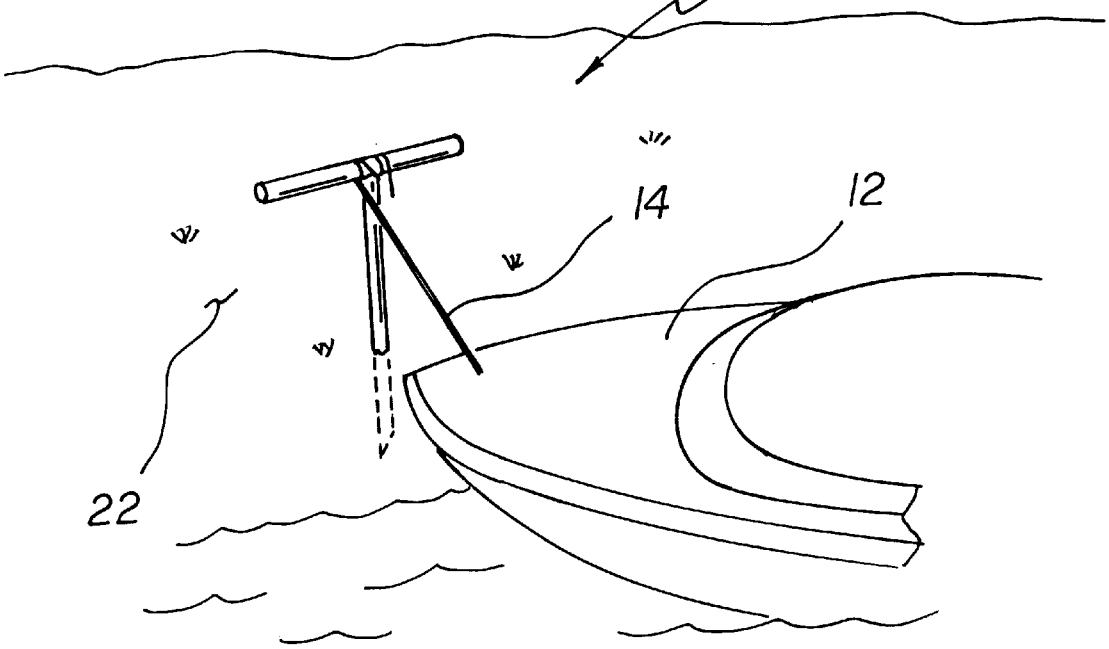
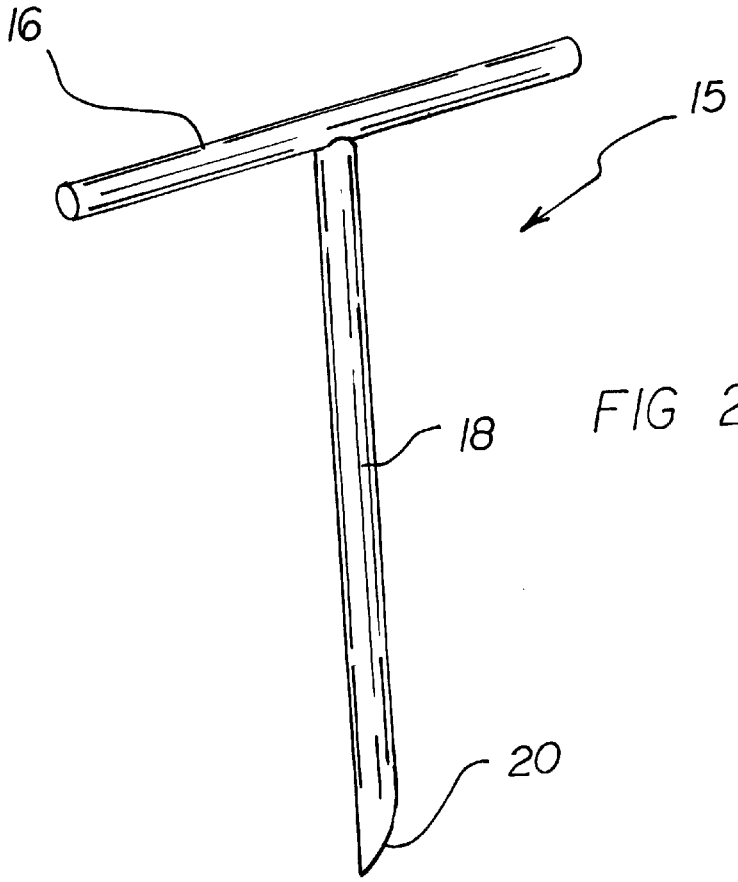
FIG 2

ANCHORING DEVICE FOR BOATS

BACKGROUND OF THE INVENTION

The present invention relates to an anchoring device for boats and more particularly pertains to securing a boat to a shoreline without having to beach the boat.

Boat owners who wish to go ashore at a place where there is no accessible docking area usually have two options. First, they can anchor their boat away from the shore and either swim or manually row a small boat or dingy to the shoreline. Second, they can beach their boat on the shoreline. Both of these options have disadvantages. The first option requires you to get wet and tired by swimming or requires the use of an additional boat which some do not have access to. The second option, if chosen, can cause damage to the hull of the boat or, in some instances, get stuck on the shoreline.

The boat owner does have anther option. This option entails driving their boat close to the shoreline and searching for a tree or other object to tie their line to. A tree or other object is not always available and is not always safe.

The present invention seeks to provide an easy solution to boat owners problems by constructing a removable boat anchor that can penetrate the shoreline and allow the line to be tied thereto.

The use of anchors is known in the prior art. More specifically, anchors heretofore devised and utilized for the purpose of anchoring a boat are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, they do not describe an anchoring device for boats for securing a boat to a shoreline without having to beach the boat.

In this respect, the anchoring device for boats according to the present invention substantially departs from the conventional concepts and designs of the prior art, and in doing so provides an apparatus primarily developed for the purpose of securing a boat to a shoreline without having to beach the boat.

Therefore, it can be appreciated that there exists a continuing need for new and improved anchoring device for boats which can be used for securing a boat to a shoreline without having to beach the boat. In this regard, the present invention substantially fulfills this need.

SUMMARY OF THE INVENTION

In the view of the foregoing disadvantages inherent in the known types of anchors now present in the prior art, the present invention provides an improved anchoring device for boats. As such, the general purpose of the present invention, which will be described subsequently in greater detail, is to provide a new and improved anchoring device for boats and method which has all the advantages of the prior art and none of the disadvantages.

To attain this, the present invention essentially comprises a boat having an anchor disposed therein. The anchor has a line extending outwardly therefrom. A T-shaped member is provided that is comprised of a horizontal component and a vertical component. An upper end of the vertical component is secured to a midpoint of the horizontal component whereby the vertical component extends downwardly from the horizontal component in an essentially orthogonal relationship. The vertical component has a length greater than a length of the horizontal component. The horizontal component and the vertical component are constructed of PVC plastic tubing. The vertical component has a pointed lower end for penetrating a recipient surface. The line from the anchor wraps around the horizontal and vertical components to facilitate securement of the boat to a shoreline.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved anchoring device for boats which has all the advantages of the prior art anchors and none of the disadvantages.

It is another object of the present invention to provide a new and improved anchoring device for boats which may be easily and efficiently manufactured and marketed.

It is a further object of the present invention to provide a new and improved anchoring device for boats which is of durable and reliable construction.

An even further object of the present invention is to provide a new and improved anchoring device for boats which is susceptible of a low cost of manufacture with regard to both materials and labor, and which accordingly is then susceptible of low prices of sale to the consuming public, thereby making such an anchoring device for boats economically available to the buying public.

Even still another object of the present invention is to provide a new and improved anchoring device for boats for securing a boat to a shoreline without having to beach the boat.

Lastly, it is an object of the present invention to provide a new and improved anchoring device for boats including a T-shaped member comprised of a horizontal component and a vertical component. An upper end of the vertical component is secured to a midpoint of the horizontal component whereby the vertical component extends downwardly from the horizontal component in an essentially orthogonal relationship. The vertical component has a length greater than a length of the horizontal component. The horizontal component and the vertical component are constructed of PVC plastic tubing. The vertical component has a pointed lower end for penetrating a recipient surface. The T-shaped member receives a line from a boat wrapped therearound to facilitate securement of the boat to a shoreline.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the anchoring device for boats constructed in accordance with the principles of the present invention.

FIG. 2 is an isolated perspective view of the present invention as illustrated in FIG. 1.

The same reference numerals refer to the same parts through the various figures.

DESCRIPTION OF THE PREFERRED EMBODIMENT

With reference now to the drawings, and in particular, to FIGS. 1 and 2 thereof, the preferred embodiment of the new and improved anchoring device for boats embodying the principles and concepts of the present invention and generally designated by the reference number 10 will be described.

Specifically, it will be noted in the various Figures that the device relates to a anchoring device for boats for securing a boat to a shoreline without having to beach the boat. In its broadest context, the device consists of a boat and a T-shaped member. Such components are individually configured and correlated with respect to each other so as to attain the desired objective.

The boat 12 has an anchor disposed therein. The anchor has a line 14 extending outwardly therefrom.

The T-shaped member 15 is comprised of a horizontal component 16 and a vertical component 18. An upper end of the vertical component 18 is secured to a midpoint of the horizontal component 16 whereby the vertical component 18 extends downwardly from the horizontal component 16 in an essentially orthogonal relationship. The vertical component 18 has a length greater than a length of the horizontal component 16. The horizontal component 16 and the vertical component 18 are constructed of PVC plastic tubing. The vertical component 18 has a pointed lower end 20 for penetrating a recipient surface. The line 14 from the anchor wraps around the horizontal and vertical components 16,18 to facilitate securement of the boat 12 to a shoreline 22.

In use, a boater would pull their boat up close to the shoreline 22 and taken the T-shaped member 15 out and drive the pointed lower end 20 of the vertical component 18 into the sand until it is stabilized. The boater will then take the line 14 from the anchor and wrap it around the T-shaped member 15 as many times as desired until a secure fit is achieved. Once finished, the boater simply unwraps the line 14 and pulls the T-shaped member 15 out of the sand and places it back in the boat 12 for the next use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An anchoring device for boats for securing a boat to a shoreline without having to beach the boat comprising, in combination:

a boat having an anchor disposed therein, the anchor having a line extending outwardly therefrom;

a T-shaped member comprised of a horizontal component and a vertical component, an upper end of the vertical component secured to a midpoint of the horizontal component whereby the vertical component extends downwardly from the horizontal component in an essentially orthogonal relationship, the vertical component having a length greater than a length of the horizontal component, the horizontal component and the vertical component being constructed of PVC plastic tubing, the vertical component having a pointed lower end for penetrating a recipient surface, the line from the anchor wrapping around the horizontal and vertical components to facilitate securement of the boat to a shoreline.

* * * * *